US011521770B2

(12) United States Patent
Yoshidome et al.

(10) Patent No.: US 11,521,770 B2
(45) Date of Patent: Dec. 6, 2022

(54) SOFT MAGNETIC ALLOY AND MAGNETIC DEVICE

(71) Applicant: TDK CORPORATION, Tokyo (JP)

(72) Inventors: Kazuhiro Yoshidome, Tokyo (JP); Hiroyuki Matsumoto, Tokyo (JP); Kenji Horino, Tokyo (JP); Hajime Amano, Tokyo (JP); Akito Hasegawa, Tokyo (JP)

(73) Assignee: TDK CORPORATION, Tokyo (JP)

( * ) Notice: Subject to any disclaimer, the term of this patent is extended or adjusted under 35 U.S.C. 154(b) by 590 days.

(21) Appl. No.: 16/430,585

(22) Filed: Jun. 4, 2019

(65) Prior Publication Data

US 2019/0385770 A1 Dec. 19, 2019

(30) Foreign Application Priority Data

Jun. 13, 2018 (JP) ..... JP2018-112919

(51) Int. Cl.

| | |
|---|---|
| ***H01F 1/153*** | (2006.01) |
| ***C22C 38/14*** | (2006.01) |
| ***C22C 38/00*** | (2006.01) |
| ***C22C 38/12*** | (2006.01) |
| ***C22C 45/02*** | (2006.01) |
| *H01F 41/02* | (2006.01) |

(52) U.S. Cl.

CPC ..... *H01F 1/15325* (2013.01); *C22C 38/002* (2013.01); *C22C 38/12* (2013.01); *C22C 38/14* (2013.01); *C22C 45/02* (2013.01); *H01F 1/15333* (2013.01); *C22C 2200/04* (2013.01); *C22C 2202/02* (2013.01); *H01F 1/15341* (2013.01); *H01F 41/0213* (2013.01); *H01F 41/0246* (2013.01)

(58) Field of Classification Search

CPC ..... C22C 1/02; C22C 33/006; C22C 33/02; C22C 33/0257; C22C 33/0278; C22C 33/04; C22C 2200/04; C22C 2202/02; H01F 1/12; H01F 1/14; H01F 1/143; H01F 1/147; H01F 1/16; H01F 1/18; H01F 1/20; H01F 1/22; H01F 1/24; H01F 1/153; H01F 1/15308; H01F 1/15333; H01F 1/15341; H01F 1/1535

See application file for complete search history.

(56) References Cited

U.S. PATENT DOCUMENTS

| | | | | |
|---|---|---|---|---|
| 2009/0065100 | A1* | 3/2009 | Yoshizawa ..... | H01F 1/15308 148/305 |
| 2010/0084056 | A1 | 4/2010 | Ohta et al. | |
| 2010/0097171 | A1 | 4/2010 | Urata et al. | |
| 2012/0199254 | A1 | 8/2012 | Urata et al. | |
| 2016/0177429 | A1 | 6/2016 | Urata et al. | |
| 2018/0073117 | A1 | 3/2018 | Urata et al. | |
| 2018/0218810 | A1 | 8/2018 | Harada et al. | |
| 2019/0156975 | A1 | 5/2019 | Urata et al. | |

FOREIGN PATENT DOCUMENTS

| | | | |
|---|---|---|---|
| EP | 3 330 985 | A1 | 6/2018 |
| JP | 2002-285305 | A | 10/2002 |
| JP | 2013-185162 | A | 9/2013 |
| JP | 6245391 | B1 | 12/2017 |
| JP | 2018-131683 | A | 8/2018 |
| WO | 2008/129803 | A1 | 10/2008 |
| WO | 2008/133302 | A1 | 11/2008 |
| WO | 2011/024580 | A1 | 3/2011 |

* cited by examiner

*Primary Examiner* — Vanessa T. Luk

(74) *Attorney, Agent, or Firm* — Oliff PLC

(57) ABSTRACT

A soft magnetic alloy includes a composition of $(Fe_{(1-(\alpha+\beta))}X1_{\alpha}X2_{\beta})_{(1-(a+b+c+d+e+f+g))}M_aTi_bB_cP_dSi_eS_fC_g$. X1 is one or more of Co and Ni. X2 is one or more of Al, Mn, Ag, Zn, Sn, As, Sb, Cu, Cr, Bi, N, O, and rare earth elements. M is one or more of Nb, Hf, Zr, Ta, Mo, W, and V. $0.020 \le a+b \le 0.140$, $0.001 \le b \le 0.140$, $0.020 < c \le 0.200$, $0.010 \le d \le 0.150$, $0 \le e \le 0.060$, $a \ge 0$, $f \ge 0$, $g \ge 0$, $a+b+c+d+e+f+g < 1$, $\alpha \ge 0$, $\beta \ge 0$, and $0 \le \alpha+\beta \le 0.50$ are satisfied. The soft magnetic alloy has a nanohetero structure or a structure of Fe-based nanocrystalline.

13 Claims, No Drawings

SOFT MAGNETIC ALLOY AND MAGNETIC DEVICE

BACKGROUND OF THE INVENTION

The present invention relates to a soft magnetic alloy and a magnetic device.

Low power consumption and high efficiency have been demanded in electronic, information, communication equipment, and the like. To achieve low power consumption and high efficiency, demanded is a soft magnetic alloy having favorable soft magnetic characteristics (low coercivity and high saturation magnetic flux density).

When the soft magnetic alloy is manufactured, a molten metal (raw material metals are melted) is normally employed, and manufacturing cost can be reduced with a low temperature of the molten metal. This is because materials used for manufacturing process, such as heat resistance materials, can have a long lifetime, and more inexpensive materials can be used for materials to be used.

Patent Document 1 discloses an invention of an iron based amorphous alloy containing Fe, Si, B, C, and P.

Patent Document 1: JP2002285305 (A)

BRIEF SUMMARY OF INVENTION

It is an object of the invention to provide a soft magnetic alloy and so on that can be manufactured even with a lower temperature of a molten metal than before and has favorable soft magnetic characteristics.

To achieve the above object, a soft magnetic alloy according to a first aspect of the present invention includes a composition of $(Fe_{(1-(\alpha+\beta))}X1_{\alpha}X2_{\beta})_{(1-(a+b+c+d+e+f+g))}M_aTi_bB_cP_dSi_eS_fC_g$, in which X1 is one or more of Co and Ni, X2 is one or more of Al, Mn, Ag, Zn, Sn, As, Sb, Cu, Cr, Bi, N, O, and rare earth elements, M is one or more of Nb, Hf, Zr, Ta, Mo, W, and V, $0.020 \le a+b \le 0.140$ is satisfied, $0.001 < b \le 0.140$ is satisfied, $0.020 < c \le 0.200$ is satisfied, $0.010 \le d \le 0.150$ is satisfied, $0 \le e \le 0.060$ is satisfied, $a \ge 0$ is satisfied, $f \ge 0$ is satisfied, $g \ge 0$ is satisfied, $a+b+c+d+e+f+g < 1$ is satisfied, $\alpha \ge 0$ is satisfied, $\beta \ge 0$ is satisfied, and $0 \le \alpha+\beta \le 0.50$ is satisfied, wherein the soft magnetic alloy has a nanohetero structure where initial fine crystal exists in an amorphous phase.

The soft magnetic alloy according to the first aspect of the present invention can be manufactured even with a lower temperature of a molten metal than before. Moreover, the soft magnetic alloy according to the first aspect of the present invention easily becomes a soft magnetic alloy having both a low coercivity and a high saturation magnetic flux density by heat treatment.

The initial fine crystal may have an average grain size of 0.3 to 10 nm.

A soft magnetic alloy according to a second aspect of the present invention includes a composition of $(Fe_{(1-(\alpha+\beta))}X1_{\alpha}X2_{\beta})_{(1-(a+b+c+d+e+f+g))}M_aTi_bB_cP_dSi_eS_fC_g$, in which X1 is one or more of Co and Ni, X2 is one or more of Al, Mn, Ag, Zn, Sn, As, Sb, Cu, Cr, Bi, N, O, and rare earth elements, M is one or more of Nb, Hf, Zr, Ta, Mo, W, and V, $0.020 \le a+b \le 0.140$ is satisfied, $0.001 < b \le 0.140$ is satisfied, $0.020 < c \le 0.200$ is satisfied, $0.010 \le d \le 0.150$ is satisfied, $0 \le e \le 0.060$ is satisfied, $a \ge 0$ is satisfied, $f \ge 0$ is satisfied, $g \ge 0$ is satisfied, $a+b+c+d+e+f+g < 1$ is satisfied, $\alpha \ge 0$ is satisfied, $\beta \ge 0$ is satisfied, and $0 \le \alpha+\beta \le 0.50$ is satisfied, wherein the soft magnetic alloy has a structure of Fe-based nanocrystalline.

The soft magnetic alloy according to the second aspect of the present invention can be manufactured even with a lower temperature of a molten metal than before. Moreover, the soft magnetic alloy according to the second aspect of the present invention has both a low coercivity and a high saturation magnetic flux density.

The Fe-based nanocrystalline may have an average grain size of 5 to 30 nm.

In the soft magnetic alloys according to the first and second aspects of the present invention, $0.010 \le b/(a+b) \le 0.500$ may be satisfied.

In the soft magnetic alloys according to the first and second aspects of the present invention, $0 \le f \le 0.020$ and $0 \le g \le 0.050$ may be satisfied.

In the soft magnetic alloys according to the first and second aspects of the present invention, $0.730 \le 1-(a+b+c+d+e+f+g) \le 0.950$ may be satisfied.

In the soft magnetic alloys according to the first and second aspects of the present invention, $0 \le \alpha\{1-(a+b+c+d+e+f+g)\} \le 0.40$ may be satisfied.

In the soft magnetic alloys according to the first and second aspects of the present invention, $\alpha=0$ may be satisfied.

In the soft magnetic alloys according to the first and second aspects of the present invention, $0 \le \beta\{1-(a+b+c+d+e+f+g)\} \le 0.030$ may be satisfied.

In the soft magnetic alloys according to the first and second aspects of the present invention, $\beta=0$ may be satisfied.

In the soft magnetic alloys according to the first and second aspects of the present invention, $\alpha=\beta=0$ may be satisfied.

The soft magnetic alloys according to the first and second aspects of the present invention may be formed in a ribbon shape.

The soft magnetic alloys according to the first and second aspects of the present invention may be formed in a powder shape.

A magnetic device according to the present invention is composed of the above-mentioned soft magnetic alloy.

DETAILED DESCRIPTION OF INVENTION

First Embodiment

A soft magnetic alloy according to First Embodiment of the present embodiment includes a composition of $(Fe_{(1-(\alpha+\beta))}X1_{\alpha}X2_{\beta})_{(1-(a+b+c+d+e+f+g))}M_aTi_bB_cP_dSi_eS_fC_g$, in which X1 is one or more of Co and Ni, X2 is one or more of Al, Mn, Ag, Zn, Sn, As, Sb, Cu, Cr, Bi, N, O, and rare earth elements, M is one or more of Nb, Hf, Zr, Ta, Mo, W, and V, $0.020 \leq a+b \leq 0.140$ is satisfied,
$0.001 \leq b \leq 0.140$ is satisfied,
$0.020 < c \leq 0.200$ is satisfied,
$0.010 \leq d \leq 0.150$ is satisfied,
$0 \leq e \leq 0.060$ is satisfied,
$a \geq 0$ is satisfied,
$f \geq 0$ is satisfied,
$g \geq 0$ is satisfied,
$a+b+c+d+e+f+g<1$ is satisfied,
$\alpha \geq 0$ is satisfied,
$\beta \geq 0$ is satisfied, and
$0 \leq \alpha+\beta \leq 0.50$ is satisfied, wherein the soft magnetic alloy has a nanohetero structure where initial fine crystal exists in an amorphous phase.

The soft magnetic alloy having the composition expressed by the above-mentioned atomic number ratio easily becomes a soft magnetic alloy that is amorphous and fails to contain crystal phases having a grain size of more than 30 nm. Then, the soft magnetic alloy according to First Embodiment has a nanohetero structure where initial fine crystal exists in an amorphous phase. Incidentally, the initial fine crystal is fine crystals having a grain size of 15 nm or less (preferably, 0.3 to 10 nm), and the nanohetero structure is a structure where the initial fine crystal exists in the amorphous phase.

Since the soft magnetic alloy according to the present embodiment has a nanohetero structure, Fe-based nanocrystalline is easily deposited in a heat treatment mentioned below. Then, a soft magnetic alloy containing Fe-based nanocrystalline (a soft magnetic alloy according to Second Embodiment mentioned below) easily has favorable magnetic characteristics.

In other words, the soft magnetic alloy having the above-mentioned composition easily becomes a starting raw material of a soft magnetic alloy where Fe-based nanocrystalline is deposited (a soft magnetic alloy according to Second Embodiment mentioned below).

Hereinafter, each component of the soft magnetic alloy according to the present embodiment is described. Incidentally, the following coercivity and saturation magnetic flux density mean a coercivity and a saturation magnetic flux density of the soft magnetic alloy according to Second Embodiment when a soft magnetic alloy containing Fe-based nanocrystalline (a soft magnetic alloy according to Second Embodiment mentioned below) is obtained by the following heat treatment.

M is one or more of Nb, Hf, Zr, Ta, Mo, W, and V. In view of improving saturation magnetic flux density, a content ratio of Nb to entire M is preferably 50 at % or more. Moreover, in view of improving saturation magnetic flux density, a content ratio of M to a total of M and Ti preferably exceeds 50%.

The M content (a) is substantially any content, but should satisfy $a \geq 0$. $a=0$ may be satisfied, that is, M may not be contained. In relation to the Ti content (b) mentioned below, however, $0.020 \leq a+b \leq 0.140$ is satisfied. When $0.020 \leq a+b \leq 0.140$ is satisfied, saturation magnetic flux density easily becomes high, and coercivity easily becomes low. When a+b is too small, coercivity easily becomes high. When a+b is too large, coercivity easily becomes high, and saturation magnetic flux density easily becomes low.

The Ti content (b) is $0.001 \leq b \leq 0.140$. Preferably, $0.020 \leq b \leq 0.100$ is satisfied. In particular, Ti can reduce a viscosity of a molten metal mentioned below. When the Ti content (b) is too small, the molten metal mentioned below has a high viscosity, and it easily becomes hard to manufacture the soft magnetic alloy at low temperature. When the Ti content (b) is too large, saturation magnetic flux density easily becomes low.

Incidentally, a content ratio of Ti to a total of M and Ti is preferably 1% or more and 50% or less. That is, $0.010 \leq b/(a+b) \leq 0.500$ is preferably satisfied, $0.014 \leq b/(a+b) \leq 0.500$ is more preferably satisfied, and $0.071 \leq b/(a+b) \leq 0.500$ is still more preferably satisfied. When b/(a+b) is within the above range, coercivity more easily becomes low, and saturation magnetic flux density more easily becomes high.

The B content (c) is $0.020 < c \leq 0.200$. Preferably, $0.025 \leq c \leq 0.200$ is satisfied. More preferably, $0.025 \leq c \leq 0.080$ is satisfied. When the B content (c) is too small, a crystal phase composed of crystals having a grain size of more than 30 nm is easily generated in the soft magnetic alloy before the following heat treatment. When the crystal phase is generated, Fe-based nanocrystalline cannot be deposited by heat treatment, and coercivity easily becomes high. When the B content (c) is too large, saturation magnetic flux density easily becomes low.

The P content (d) is $0.010 \leq d \leq 0.150$. Preferably, $0.010 \leq d \leq 0.030$ is satisfied. In particular, P can reduce a melting point of a molten metal mentioned below. When the P content (d) is too small, the molten metal mentioned below has a high melting point, and it easily becomes hard to manufacture the soft magnetic alloy at low temperature. When the P content (d) is too large, saturation magnetic flux density easily becomes low.

The Si content (e) is $0 \leq e \leq 0.060$. $e=0$ may be satisfied, that is, Si may not be contained. When the Si content (e) is too large, saturation magnetic flux density easily becomes low.

The S content (f) and the C content (g) are substantially any content, but $f \geq 0$ and $g \geq 0$ should be satisfied. $f=0$ may be satisfied, that is, S may not be contained. $g=0$ may be satisfied, that is, C may not be contained.

When S and/or C is/are contained, a molten metal mentioned below can have a lower viscosity, and the soft magnetic alloy can be manufactured with a lower temperature of the molten metal, compared to when neither S nor C is contained. When the molten metal has a lower temperature, coercivity can be lower.

The S content (f) is preferably $0.005 \leq f \leq 0.020$ and is more preferably $0.005 \leq f \leq 0.010$. The C content (g) is preferably $0.010 \leq g \leq 0.050$ and is more preferably $0.010 \leq g \leq 0.030$.

The F content $(1-(a+b+c+d+e+f+g))$ may be any content. Preferably, $0.730 \leq 1-(a+b+c+d+e+f+g) \leq 0.950$ is satisfied.

In the soft magnetic alloy according to the present embodiment, a part of Fe may be substituted by X1 and/or X2.

X1 is one or more of Co and Ni. The X1 content may be $\alpha=0$. That is, X1 may not be contained. Preferably, the number of atoms of X1 is 40 at % or less if the number of atoms of the entire composition is 100 at %. That is, $0 \leq \alpha\{1-(a+b+c+d+e+f+g)\} \leq 0.400$ is preferably satisfied.

X2 is one or more of Al, Mn, Ag, Zn, Sn, As, Sb, Cu, Cr, Bi, N, O, and rare earth elements. The X2 content may be $\beta=0$. That is, X2 may not be contained. Preferably, the number of atoms of X2 is 3.0 at % or less if the number of atoms of the entire composition is 100 at %. That is, $0 \leq \beta\{1-(a+b+c+d+e+f+g)\} \leq 0.030$ is preferably satisfied.

The substitution amount of Fe by X1 and/or X2 is half or less of Fe based on the number of atoms. That is, $0 \leq \alpha+\beta \leq 0.50$ is satisfied. When $\alpha+\beta>0.50$ is satisfied, an Fe-based nanocrystalline alloy is hard to be obtained by heat treatment.

Incidentally, the soft magnetic alloys according to the present embodiment may contain elements other than the above-mentioned elements as unavoidable impurities. For example, 0.1 wt % or less of unavoidable impurities may be contained with respect to 100 wt % of the soft magnetic alloy.

Hereinafter, a method of manufacturing the soft magnetic alloy according to First Embodiment is explained.

The soft magnetic alloy according to First Embodiment is manufactured by any method. For example, a ribbon of the soft magnetic alloy according to First Embodiment is manufactured by a single roller method. The ribbon may be a continuous ribbon.

In the single roller method, pure metals of respective metal elements contained in a soft magnetic alloy finally obtained are initially prepared and weighed so that a composition identical to that of the soft magnetic alloy finally obtained is obtained. Then, the pure metal of each metal element is melted and mixed, and a base alloy is prepared. Incidentally, the pure metals are melted by any method. For example, the pure metals are melted by high-frequency heating in an evacuated chamber. Incidentally, the base alloy and the soft magnetic alloy containing initial fine crystal (soft magnetic alloy according to First Embodiment) normally have the same composition. Moreover, the soft magnetic alloy containing initial fine crystal (soft magnetic alloy according to First Embodiment) and a soft magnetic alloy containing Fe-based nanocrystalline (soft magnetic alloy according to Second Embodiment mentioned below) obtained by carrying out a heat treatment against the soft magnetic alloy containing the initial fine crystal normally have the same composition.

Next, the manufactured base alloy is heated and melted to obtain a molten metal. When the soft magnetic alloy according to the present embodiment is manufactured, the molten metal can have a lower temperature than before. For example, the molten metal has a temperature of 1100° C. or more and less than 1200° C. Preferably, the molten metal has a temperature of 1150° C. or more and 1175° C. or less. In view of easily manufacturing the soft magnetic alloy according to the present embodiment, the molten metal preferably has a higher temperature. In view of reducing manufacturing cost and coercivity, the molten metal preferably has a lower temperature.

In the single roller method, the thickness of the ribbon to be obtained can be controlled by mainly controlling the rotating speed of the roller, but can also be controlled by, for example, controlling the distance between the nozzle and the roller, the temperature of the molten metal, and the like. The ribbon has any thickness, but can have a thickness that is larger than before if the soft magnetic alloy according to the present embodiment is manufactured. For example, the ribbon may have a thickness of 20 to 60 μm (preferably, 50 to 55 μm). When the ribbon is thicker than before, DC superposition characteristics are favorable because a filling density can be improved in manufacturing a troidal core wound by the ribbon. The soft magnetic alloy according to the present embodiment has a higher amorphous property compared to conventional soft magnetic alloys. Thus, even if the ribbon is thick, crystals having a grain size of more than 30 nm are hard to be generated before heat treatment. Moreover, a soft magnetic alloy containing Fe-based nanocrystalline is easily obtained after heat treatment.

The soft magnetic alloy according to First Embodiment is composed of an amorphous phase failing to contain crystals having a grain size of more than 30 nm. When the amorphous alloy undergoes the following heat treatment, an Fe-based nanocrystalline alloy according to Second Embodiment mentioned below can be obtained.

Incidentally, whether or not the ribbon of the soft magnetic alloy contains crystals having a grain size of more than 30 nm is confirmed by any method. For example, the existence of crystals having a grain size of more than 30 nm can be confirmed by a normal X-ray diffraction measurement.

The soft magnetic alloy according to First Embodiment has a nanohetero structure composed of amorphous phases and initial fine crystal existing in the amorphous phases. Incidentally, the initial fine crystal has any grain size, but preferably have an average grain size of 0.3 to 10 nm.

The existence and average grain size of the above-mentioned initial fine crystal are observed by any method, and can be observed by, for example, obtaining a selected area electron diffraction image, a nano beam diffraction image, a bright field image, or a high resolution image using a transmission electron microscope with respect to a sample thinned by ion milling. When using a selected area electron diffraction image or a nano beam diffraction image, with respect to diffraction pattern, a ring-shaped diffraction is formed in case of being amorphous, and diffraction spots due to crystal structure are formed in case of being non-amorphous. When using a bright field image or a high resolution image, an existence and an average grain size of initial fine crystal can be confirmed by visual observation with a magnification of $1.00\times10^5$ to $3.00\times10^5$.

The roller has any temperature and rotating speed, and the chamber has any atmosphere. Preferably, the roller has a temperature of 4 to 30° C. for amorphization. The faster a rotating speed of the roller is, the thinner the ribbon to be formed is. Preferably, the atmosphere of the chamber is an inert atmosphere (e.g., argon, nitrogen) or an air in view of cost.

In addition to the above-mentioned single roller method, a powder of the soft magnetic alloy according to First Embodiment is obtained by a water atomizing method or a gas atomizing method, for example. Hereinafter, a gas atomizing method is explained.

In a gas atomizing method, a molten alloy of 1100° C. or more and less than 1200° C. is obtained similarly to the above-mentioned single roller method. Thereafter, the molten alloy is sprayed in a chamber, and a powder is prepared.

At this time, the nanohetero structure according to the present embodiment is obtained easily with a gas spray temperature of 50 to 90° C. and a vapor pressure of 4 hPa or less in the chamber.

Second Embodiment

Hereinafter, Second Embodiment of the present invention is described, but overlapping matters with First Embodiment are not properly described.

A soft magnetic alloy according to Second Embodiment of the present invention includes a composition of $(Fe_{(1-(\alpha+\beta))}X1_{\alpha}X2_{\beta})_{(1-(a+b+c+d+e+f+g))}M_aTi_bB_cP_dSi_eS_fC_g$, in which X1 is one or more of Co and Ni, X2 is one or more of Al, Mn, Ag, Zn, Sn, As, Sb, Cu, Cr, Bi, N, O, and rare earth elements, M is one or more of Nb, Hf, Zr, Ta, Mo, W, and V, $0.020\leq a+b\leq0.140$ is satisfied, $0.001<b\leq0.140$ is satisfied, $0.020<c\leq0.200$ is satisfied, $0.010\leq d\leq0.150$ is satisfied, $0\leq e\leq0.060$ is satisfied, $a\geq0$ is satisfied, $f\geq0$ is satisfied, $g\geq0$ is satisfied, $a+b+c+d+e+f+g<1$ is satisfied, $\alpha \geq 0$ is satisfied, $\beta \geq 0$ is satisfied, and $0 \leq \alpha+\beta \leq 0.50$ is satisfied, wherein the soft magnetic alloy has a structure of Fe-based nanocrystalline.

The above-mentioned composition has the same composition as the soft magnetic alloy according to First Embodiment. Unlike the soft magnetic alloy according to First Embodiment, the soft magnetic alloy according to Second Embodiment has a structure of Fe-based nanocrystalline.

The Fe-based nanocrystalline is crystalline whose grain size is in nano order and whose crystal structure of Fe is a body-centered cubic lattice structure (bcc). In the present embodiment, Fe-based nanocrystalline having an average grain size of 5 to 30 nm are preferably deposited. A soft magnetic alloy where such Fe-based nanocrystalline is deposited easily has a high saturation magnetic flux density and a low coercivity.

Hereinafter, a method of manufacturing the soft magnetic alloy according to Second Embodiment is described.

The soft magnetic alloy according to Second Embodiment is manufactured by any method. For example, the soft magnetic alloy according to Second Embodiment can be manufactured by carrying out a heat treatment against the soft magnetic alloy having a nanohetero structure according to First Embodiment, but can also be manufactured by carrying out a heat treatment against a soft magnetic alloy failing to have a nanohetero structure and failing to contain crystals (including initial fine crystal).

There is no limit to heat treatment conditions for manufacturing the Fe-based nanocrystalline. Favorable heat treatment conditions vary depending upon the composition of the soft magnetic alloy, the existence of the nanohetero structure of the soft magnetic alloy before heat treatment, and the like, but a favorable heat treatment temperature is about 500 to 650° C., and a favorable heat treatment time is about 0.1 to 3 hours. Depending upon composition, shape, etc., however, a favorable heat treatment temperature and a favorable heat treatment time may be in the other ranges. For example, when a soft magnetic alloy having a nanohetero structure (a soft magnetic alloy according to First Embodiment) undergoes a heat treatment, a favorable heat treatment temperature tends to be lower compared to when a soft magnetic alloy failing to have a nanohetero structure. Preferably, the heat treatment is carried out in an inert atmosphere, such as Ar gas atmosphere.

Any method, such as observation using a transmission electron microscope, is employed for calculation of an average grain size of the obtained Fe-based nanocrystalline alloy. The crystal structure of body-centered cubic structure (bcc) is also confirmed by any method, such as X-ray diffraction measurement.

Hereinbefore, an embodiment of the present embodiment is described, but the present invention is not limited to the above-mentioned embodiment.

The soft magnetic alloys according to First Embodiment and Second Embodiment have any shape, such as ribbon shape and powder shape as described above, but may also have a block shape or so.

The soft magnetic alloy according to Second Embodiment (Fe-based nanocrystalline alloy) is used for any purposes, such as magnetic devices (particularly, magnetic cores). The soft magnetic alloy according to Second Embodiment (Fe-based nanocrystalline alloy) can favorably be used as magnetic cores for inductors (particularly, for power inductors). In addition to magnetic cores, the soft magnetic alloy according to Second Embodiment can favorably be used for thin film inductors, magnetic heads, and the like.

Hereinafter, described is a method of obtaining magnetic devices (particularly, magnetic cores and inductors) from the soft magnetic alloy according to Second Embodiment, but the following method is not the only one method for obtaining magnetic cores and inductors from the soft magnetic alloy according to Second Embodiment. In addition to inductors, the magnetic cores are used for transformers, motors, and the like.

For example, a magnetic core from a ribbon-shaped soft magnetic alloy is obtained by winding or laminating the ribbon-shaped soft magnetic alloy. When the ribbon-shaped soft magnetic alloy is laminated via an insulator, a magnetic core having further improved properties can be obtained.

For example, a magnetic core from a powder-shaped soft magnetic alloy is obtained by appropriately mixing the powder-shaped soft magnetic alloy with a binder and pressing this using a die. When an oxidation treatment, an insulation coating, or the like is carried out against the surface of the powder before the mixture with the binder, a magnetic core having an improved resistivity and being more suitable for high-frequency regions is obtained.

The pressing method is not limited. Examples of the pressing method include a pressing using a die and a mold pressing. There is no limit to the type of the binder. Examples of the binder include a silicone resin. There is no limit to a mixture ratio between the soft magnetic alloy powder and the binder either. For example, 1 to 10 mass % of the binder is mixed with 100 mass % of the soft magnetic alloy powder.

For example, 100 mass % of the soft magnetic alloy powder is mixed with 1 to 5 mass % of a binder and compressively pressed using a die, and it is thereby possible to obtain a magnetic core having a space factor (powder filling rate) of 70% or more, a magnetic flux density of 0.45 T or more at the time of applying a magnetic field of $1.6\times10^4$ A/m, and a resistivity of 1 Ω·cm or more. These properties are equivalent to or more excellent than those of normal ferrite magnetic cores.

For example, 100 mass % of the soft magnetic alloy powder is mixed with 1 to 3 mass % of a binder and compressively pressed using a die under a temperature condition that is equal to or higher than a softening point of the binder, and it is thereby possible to obtain a dust core having a space factor of 80% or more, a magnetic flux density of 0.9 T or more at the time of applying a magnetic field of $1.6\times10^4$ A/m, and a resistivity of 0.1 Ω·cm or more. These properties are more excellent than those of normal dust cores.

Moreover, a green compact constituting the above-mentioned magnetic core undergoes a heat treatment after the pressing for distortion removal. This further reduces core loss and improves usefulness. Incidentally, core loss of the magnetic core is decreased by reduction in coercivity of a magnetic material constituting the magnetic core.

An inductance product is obtained by winding a wire around the above-mentioned magnetic core. The wire is wound by any method, and the inductance product is manufactured by any method. For example, a wire is wound around a magnetic core manufactured by the above-mentioned method at least in one or more turns.

Moreover, when using soft magnetic alloy grains, there is a method of manufacturing an inductance product by pressing and integrating a magnetic material incorporating a winding wire coil. In this case, an inductance product corresponding to high frequencies and large electric current is obtained easily.

Moreover, when using soft magnetic alloy grains, an inductance product can be obtained by carrying out firing after alternately printing and laminating a soft magnetic alloy paste obtained by pasting the soft magnetic alloy grains added with a binder and a solvent and a conductor paste obtained by pasting a conductor metal for coils added with a binder and a solvent. Instead, an inductance product where a coil is incorporated into a magnetic material can be obtained by preparing a soft magnetic alloy sheet using a soft magnetic alloy paste, printing a conductor paste on the surface of the soft magnetic alloy sheet, and laminating and firing them.

Here, when an inductance product is manufactured using soft magnetic alloy grains, in view of obtaining excellent Q properties, it is preferred to use a soft magnetic alloy powder whose maximum grain size is 45 μm or less by sieve diameter and center grain size (D50) is 30 μm or less. In order to have a maximum grain size of 45 μm or less by sieve diameter, only a soft magnetic alloy powder that passes through a sieve whose mesh size is 45 μm may be used.

The larger a maximum grain size of a soft magnetic alloy powder is, the further Q values in high-frequency regions tend to decrease. In particular, when using a soft magnetic alloy powder whose maximum grain diameter is larger than 45 μm by sieve diameter, Q values in high-frequency regions may decrease greatly. When Q values in high-frequency regions are not very important, however, a soft magnetic alloy powder having a large variation can be used. When a soft magnetic alloy powder having a large variation is used, cost can be reduced as it can be manufactured comparatively inexpensively.

EXAMPLES

Hereinafter, the present invention is specifically explained based on Examples.

Experimental Example 1

Raw material metals were weighed so that the alloy compositions of Examples and Comparative Examples shown in the following table would be obtained, and the weighed raw material metals were melted by high-frequency heating. Then, base alloys were manufactured.

Each of the manufactured base alloys was thereafter heated, melted, and turned into a molten metal at the spray temperature in the following table. After that, each molten metal was sprayed against a roller (25° C.) rotating at 15 m/sec. (single roller method) in an inert atmosphere (Ar atmosphere), and a ribbon (thickness: 50 μm) was thereby obtained. Incidentally, whether or not the ribbon was manufactured by the spray was evaluated. In the following table, ○ is displayed in a spray cell when the ribbon was manufactured, and X is displayed in a spray cell when the ribbon was not manufactured. The width of the ribbon was about 1 mm, and the length of the ribbon was about 10 m.

In each of the obtained ribbons, a surface rapidly cooled by the roller was a roller surface, and the opposite surface to the roller surface was a free surface. The free surface of each of the obtained ribbons underwent an X-ray diffraction measurement, and whether or not a peak due to α-Fe existed in 2θ=40° to 50° was confirmed. When no peaks due to α-Fe existed, the ribbon was considered to be amorphous. When a peak due to α-Fe existed, this peak due to α-Fe was analyzed, and the ribbon was considered to be crystalline if crystals having a grain size of more than 30 nm existed. Incidentally, the ribbon was also considered to be amorphous if only initial fine crystal having a grain size of 15 nm or less was contained, but the initial fine crystal was not confirmed in any of examples of Experimental Examples 1 and 2 mentioned below.

After that, the ribbon of each of examples and comparative examples underwent a heat treatment at 600° C. for 30 minutes. Each of the ribbons after the heat treatment was measured for coercivity and saturation magnetic flux density. A melting point was measured using a differential scanning calorimeter (DSC). The coercivity (Hc) was measured at a magnetic field (5 kA/m) using a DC BH tracer. The saturation magnetic flux density (Bs) was measured at a magnetic field (1000 kA/m) using a vibration sample magnetometer (VSM). In Examples, a coercivity of 3.0 A/m or less was considered to be favorable, and a coercivity of less than 2.5 A/m or less was considered to be more favorable. In Examples, a saturation magnetic flux density of 1.40 T or more was considered to be favorable, and a saturation magnetic flux density of 1.55 T or more was considered to be more favorable.

Incidentally, unless otherwise stated, the fact that all of the following examples contained Fe-based nanocrystalline having an average grain size of 5 to 30 nm and a bcc crystalline structure was confirmed by an X-ray diffraction measurement and an observation using a transmission electron microscope.

TABLE 1

| Sample No. | Example/ Comparative Example | (Fe (1 − (a + b + c + d + e + f + g) ) MaTibBcPdSieSfCg (α = β = 0 f = g = 0) | | | | | | | | | | Spray Temperature (° C.) | Spray | Ribbon Thickness (μm) | XRD | Hc (A/m) | Bs (T) |
|---|---|---|---|---|---|---|---|---|---|---|---|---|---|---|---|---|---|
| | | Fe | M = Nb a | Ti b | B c | P d | Si e | S f | C g | a + b | b/(a + b) | | | | | | |
| 1 | Comp. Ex. | 0.850 | 0.50 | ***0.000*** | 0.100 | ***0.000*** | 0.000 | 0.000 | 0.000 | 0.050 | 0.000 | ***1200*** | ○ | 20 | amorphous phase | 2.5 | 1.53 |
| 2 | Comp. Ex. | 0.850 | 0.50 | ***0.000*** | 0.100 | ***0.000*** | 0.000 | 0.000 | 0.000 | 0.050 | 0.000 | ***1200*** | ○ | 50 | ***crystalline phase*** | ***189*** | 1.52 |
| 3 | Comp. Ex. | 0.850 | 0.50 | ***0.000*** | 0.100 | ***0.000*** | 0.000 | 0.000 | 0.000 | 0.050 | 0.000 | 1175 | ✗ | — | — | — | — |
| 4 | Comp. Ex. | 0.840 | 0.50 | 0.010 | 0.100 | ***0.000*** | 0.000 | 0.000 | 0.000 | 0.060 | 0.167 | 1175 | ✗ | — | — | — | — |

TABLE 1-continued

| Sample No. | Example/ Comparative Example | (Fe (1 − (a + b + c + d + e + f + g) ) MaTibBcPdSieSfCg (α = β = 0 f = g = 0) Fe | M = Nb a | Ti b | B c | P d | Si e | S f | C g | a + b | b/(a + b) | Spray Temperature (° C.) | Spray | Ribbon Thickness (μm) | XRD | Hc (A/m) | Bs (T) |
|---|---|---|---|---|---|---|---|---|---|---|---|---|---|---|---|---|---|
| 5 | Comp. Ex. | 0.850 | 0.50 | ***0.000*** | 0.070 | 0.030 | 0.000 | 0.000 | 0.000 | 0.050 | 0.000 | 1175 | ✗ | — | — | — | — |
| 6 | Comp. Ex. | 0.850 | 0.40 | 0.010 | 0.070 | 0.030 | 0.000 | 0.000 | 0.000 | 0.050 | 0.200 | ***1200*** | ○ | 50 | ***crystalline phase*** | ***134*** | 1.56 |
| 7 | Ex. | 0.850 | 0.40 | 0.010 | 0.070 | 0.030 | 0.000 | 0.000 | 0.000 | 0.050 | 0.200 | 1175 | ○ | 50 | amorphous phase | 2.1 | 1.57 |

Table 1 shows confirmation results of differences in existence of Ti and/or P with a spray temperature (temperature of molten metal) of 1200° C. or 1175° C.

In Sample No. 7 (Ti and P were contained, and the spray temperature was 1175° C.), the coercivity and the saturation magnetic flux density were favorable. On the other hand, when neither Ti nor P was contained, Sample No. 1 and Sample No. 2 (the spray temperature was 1200° C.) were different from each other only in thickness of ribbon. In Sample No. 1, since the ribbon was thin, a ribbon composed of uniformly amorphous phases was manufactured. In Sample No. 2, since the ribbon was thicker than that of Sample No. 1, the ribbon had a large thermal capacity and was not entirely uniformly rapidly cooled, and a uniformly amorphous phase was not consequently formed. Thus, in Sample No. 2, the ribbon before the heat treatment was crystalline, and the ribbon after the heat treatment had a significantly large coercivity. In Sample No. 3 (the spray temperature was 1175° C.), no ribbon was formed. In Sample No. 4 and Sample No. 5 (Ti or P was not contained, and the spray temperature was 1175° C.), no ribbon was formed. In Sample No. 6 (Ti and P were contained, and the spray temperature was 1200° C.), the ribbon before the heat treatment was crystalline, and the ribbon after the heat treatment had a significantly large coercivity.

Experimental Example 2

In Experimental Example 2, ribbons were manufactured in a similar manner to Experimental Example 1 except that the composition of the base alloy was changed with a spray temperature (1175° C.) to the exclusion of Sample No. 52 and Sample No. 59 to Sample No. 64 mentioned below.

TABLE 2

| Sample No. | Example/ Comparative Example | (Fe (1 − (a + b + c + d + e + f + g) ) MaTibBcPdSieSfCg (α = β = 0 f = g = 0) Main Component Fe | M = Nb a | Ti b | B c | P d | Si e | S f | C g | a + b | b/(a + b) | 1175° C. Spray | XRD | Hc (A/m) | Bs (T) |
|---|---|---|---|---|---|---|---|---|---|---|---|---|---|---|---|
| 12 | Comp. Ex. | 0.800 | 0.070 | *0.000* | 0.100 | 0.030 | 0.000 | 0.000 | 0.000 | 0.070 | 0.000 | x | — | — | — |
| 13 | Ex. | 0.799 | 0.070 | 0.001 | 0.100 | 0.030 | 0.000 | 0.000 | 0.000 | 0.071 | 0.014 | ○ | amorphous phase | 2.8 | 1.58 |
| 14 | Ex. | 0.795 | 0.070 | 0.005 | 0.100 | 0.030 | 0.000 | 0.000 | 0.000 | 0.075 | 0.067 | ○ | amorphous phase | 2.9 | 1.57 |
| 15 | Ex. | 0.790 | 0.070 | 0.010 | 0.100 | 0.030 | 0.000 | 0.000 | 0.000 | 0.080 | 0.125 | ○ | amorphous phase | 2.6 | 1.53 |
| 16 | Ex. | 0.770 | 0.070 | 0.030 | 0.100 | 0.030 | 0.000 | 0.000 | 0.000 | 0.100 | 0.300 | ○ | amorphous phase | 2.3 | 1.50 |
| 17 | Ex. | 0.750 | 0.070 | 0.050 | 0.100 | 0.030 | 0.000 | 0.000 | 0.000 | 0.120 | 0.417 | ○ | amorphous phase | 2.1 | 1.48 |
| 18 | Ex. | 0.730 | 0.070 | 0.070 | 0.100 | 0.030 | 0.000 | 0.000 | 0.000 | 0.140 | 0.500 | ○ | amorphous phase | 2.1 | 1.42 |
| 19 | Comp. Ex. | 0.720 | 0.070 | 0.080 | 0.100 | 0.030 | 0.000 | 0.000 | 0.000 | *0.150* | 0.533 | ○ | amorphous phase | *3.2* | *1.38* |
| 20 | Comp. Ex. | 0.855 | 0.000 | 0.015 | 0.100 | 0.030 | 0.000 | 0.000 | 0.000 | *0.015* | 1.000 | ○ | amorphous phase | *4.8* | 1.62 |
| 21 | Ex. | 0.850 | 0.000 | 0.020 | 0.100 | 0.030 | 0.000 | 0.000 | 0.000 | 0.020 | 1.000 | ○ | amorphous phase | 2.3 | 1.59 |
| 22 | Ex. | 0.820 | 0.000 | 0.050 | 0.100 | 0.030 | 0.000 | 0.000 | 0.000 | 0.050 | 1.000 | ○ | amorphous phase | 1.7 | 1.53 |
| 23 | Ex. | 0.770 | 0.000 | 0.100 | 0.100 | 0.030 | 0.000 | 0.000 | 0.000 | 0.100 | 1.000 | ○ | amorphous phase | 2.3 | 1.45 |
| 24 | Ex. | 0.730 | 0.000 | 0.140 | 0.100 | 0.030 | 0.000 | 0.000 | 0.000 | 0.140 | 1.000 | ○ | amorphous phase | 2.5 | 1.41 |
| 25 | Comp. Ex. | 0.720 | 0.000 | *0.150* | 0.100 | 0.030 | 0.000 | 0.000 | 0.000 | *0.150* | 1.000 | ○ | amorphous phase | 2.1 | *1.32* |
| 26 | Comp. Ex. | 0.880 | 0.060 | 0.010 | *0.020* | 0.030 | 0.000 | 0.000 | 0.000 | 0.070 | 0.143 | ○ | *crystalline phase* | *182* | 1.61 |
| 27 | Ex. | 0.875 | 0.060 | 0.010 | 0.025 | 0.030 | 0.000 | 0.000 | 0.000 | 0.070 | 0.143 | ○ | amorphous phase | 2.2 | 1.58 |
| 28 | Ex. | 0.840 | 0.060 | 0.010 | 0.060 | 0.030 | 0.000 | 0.000 | 0.000 | 0.070 | 0.143 | ○ | amorphous phase | 2.3 | 1.57 |
| 29 | Ex. | 0.820 | 0.060 | 0.010 | 0.080 | 0.030 | 0.000 | 0.000 | 0.000 | 0.070 | 0.143 | ○ | amorphous phase | 2.3 | 1.55 |
| 30 | Ex. | 0.780 | 0.060 | 0.010 | 0.120 | 0.030 | 0.000 | 0.000 | 0.000 | 0.070 | 0.143 | ○ | amorphous phase | 2.4 | 1.44 |
| 31 | Ex. | 0.750 | 0.060 | 0.010 | 0.150 | 0.030 | 0.000 | 0.000 | 0.000 | 0.070 | 0.143 | ○ | amorphous phase | 2.1 | 1.43 |
| 32 | Ex. | 0.700 | 0.060 | 0.010 | 0.200 | 0.030 | 0.000 | 0.000 | 0.000 | 0.070 | 0.143 | ○ | amorphous phase | 2.2 | 1.41 |
| 33 | Comp. Ex. | 0.690 | 0.060 | 0.010 | *0.210* | 0.030 | 0.000 | 0.000 | 0.000 | 0.070 | 0.143 | ○ | amorphous phase | 2.3 | *1.35* |
| 34 | Comp. Ex. | 0.830 | 0.060 | 0.010 | 0.100 | *0.000* | 0.000 | 0.000 | 0.000 | 0.070 | 0.143 | x | — | — | — |
| 35 | Ex. | 0.820 | 0.060 | 0.010 | 0.100 | 0.010 | 0.000 | 0.000 | 0.000 | 0.070 | 0.143 | ○ | amorphous phase | 2.2 | 1.53 |
| 36 | Ex. | 0.800 | 0.060 | 0.010 | 0.100 | 0.030 | 0.000 | 0.000 | 0.000 | 0.070 | 0.143 | ○ | amorphous phase | 2.3 | 1.55 |
| 37 | Ex. | 0.780 | 0.060 | 0.010 | 0.100 | 0.050 | 0.000 | 0.000 | 0.000 | 0.070 | 0.143 | ○ | amorphous phase | 2.1 | 1.43 |
| 38 | Ex. | 0.730 | 0.060 | 0.010 | 0.100 | 0.100 | 0.000 | 0.000 | 0.000 | 0.070 | 0.143 | ○ | amorphous phase | 2.2 | 1.42 |
| 39 | Ex. | 0.680 | 0.060 | 0.010 | 0.100 | 0.150 | 0.000 | 0.000 | 0.000 | 0.070 | 0.143 | ○ | amorphous phase | 2.4 | 1.41 |
| 40 | Comp. Ex. | 0.670 | 0.060 | 0.010 | 0.100 | *0.160* | 0.000 | 0.000 | 0.000 | 0.070 | 0.143 | ○ | amorphous phase | 2.6 | *1.34* |
| 29 | Ex. | 0.820 | 0.060 | 0.010 | 0.080 | 0.030 | 0.000 | 0.000 | 0.000 | 0.070 | 0.143 | ○ | amorphous phase | 2.3 | 1.55 |

TABLE 2-continued

| Sample No. | Example/ Comparative Example | (Fe (1 − (a + b + c + d + e + f + g) ) MaTibBcPdSieSfCg (α = β = 0 f = g = 0) Main Component Fe | M = Nb a | Ti b | B c | P d | Si e | S f | C g | a + b | b/(a + b) | 1175° C. Spray | XRD | Hc (A/m) | Bs (T) |
|---|---|---|---|---|---|---|---|---|---|---|---|---|---|---|---|
| 41 | Ex. | 0.810 | 0.060 | 0.010 | 0.080 | 0.030 | 0.010 | 0.000 | 0.000 | 0.070 | 0.143 | ○ | amorphous phase | 2.1 | 1.52 |
| 42 | Ex. | 0.790 | 0.060 | 0.010 | 0.080 | 0.030 | 0.030 | 0.000 | 0.000 | 0.070 | 0.143 | ○ | amorphous phase | 2.0 | 1.45 |
| 43 | Ex. | 0.760 | 0.060 | 0.010 | 0.080 | 0.030 | 0.060 | 0.000 | 0.000 | 0.070 | 0.143 | ○ | amorphous phase | 1.9 | 1.41 |
| 44 | Comp. Ex. | 0.750 | 0.060 | 0.010 | 0.080 | 0.030 | *0.070* | 0.000 | 0.000 | 0.070 | 0.143 | ○ | amorphous phase | 2.2 | *1.38* |

TABLE 3

| Sample No. | Example/ Comparative Example | (Fe (1 − (a + b + c + d + e + f + g) ) MaTibBcPdSieSfCg (α = β = 0) Main Component Fe | M = Nb a | Ti b | B c | P d | Si e | S f | C g | a + b | b/(a + b) | 1175° C. Spray | XRD | Hc (A/m) | Bs (T) |
|---|---|---|---|---|---|---|---|---|---|---|---|---|---|---|---|
| 45 | Comp. Ex. | 0.800 | 0.070 | *0.000* | 0.100 | 0.030 | 0.000 | 0.000 | 0.000 | 0.070 | 0.000 | x | — | — | — |
| 46 | Ex. | 0.800 | 0.069 | 0.001 | 0.100 | 0.030 | 0.000 | 0.000 | 0.000 | 0.070 | 0.014 | ○ | amorphous phase | 2.5 | 1.58 |
| 47 | Ex. | 0.800 | 0.065 | 0.005 | 0.100 | 0.030 | 0.000 | 0.000 | 0.000 | 0.070 | 0.071 | ○ | amorphous phase | 2.4 | 1.59 |
| 48 | Ex. | 0.800 | 0.060 | 0.010 | 0.100 | 0.030 | 0.000 | 0.000 | 0.000 | 0.070 | 0.143 | ○ | amorphous phase | 2.4 | 1.60 |
| 49 | Ex. | 0.800 | 0.035 | 0.035 | 0.100 | 0.030 | 0.000 | 0.000 | 0.000 | 0.070 | 0.500 | ○ | amorphous phase | 2.4 | 1.56 |
| 50 | Ex. | 0.800 | 0.020 | 0.050 | 0.100 | 0.030 | 0.000 | 0.000 | 0.000 | 0.070 | 0.714 | ○ | amorphous phase | 2.3 | 1.53 |
| 51 | Ex. | 0.800 | 0.000 | 0.070 | 0.100 | 0.030 | 0.000 | 0.000 | 0.000 | 0.070 | 1.000 | ○ | amorphous phase | 2.3 | 1.50 |

TABLE 4

| Sample No. | Example/ Comparative Example | (Fe (1 − (a + b + c + d + e + f + g) ) MaTibBcPdSieSfCg (α = β = 0) Fe | M = Nb a | Ti b | B c | P d | Si e | S f | C g | a + b | b/(a + b) | Spray Temperature (° C.) | Spray | XRD | Hc (A/m) | Bs (T) |
|---|---|---|---|---|---|---|---|---|---|---|---|---|---|---|---|---|
| 29 | Ex. | 0.820 | 0.060 | 0.010 | 0.080 | 0.030 | 0.000 | 0.000 | 0.000 | 0.070 | 0.143 | 1175 | ○ | amorphous phase | 2.3 | 1.55 |
| 53 | Ex. | 0.815 | 0.060 | 0.010 | 0.080 | 0.030 | 0.000 | 0.005 | 0.000 | 0.070 | 0.143 | 1175 | ○ | amorphous phase | 2.2 | 1.53 |
| 54 | Ex. | 0.810 | 0.060 | 0.010 | 0.080 | 0.030 | 0.000 | 0.010 | 0.000 | 0.070 | 0.143 | 1175 | ○ | amorphous phase | 2.4 | 1.54 |
| 55 | Ex. | 0.800 | 0.060 | 0.010 | 0.080 | 0.030 | 0.000 | 0.020 | 0.000 | 0.070 | 0.143 | 1175 | ○ | amorphous phase | 2.5 | 1.52 |
| 56 | Ex. | 0.810 | 0.060 | 0.010 | 0.080 | 0.030 | 0.000 | 0.000 | 0.010 | 0.070 | 0.143 | 1175 | ○ | amorphous phase | 2.4 | 1.56 |
| 57 | Ex. | 0.790 | 0.060 | 0.010 | 0.080 | 0.030 | 0.000 | 0.000 | 0.030 | 0.070 | 0.143 | 1175 | ○ | amorphous phase | 2.6 | 1.52 |
| 58 | Ex. | 0.770 | 0.060 | 0.010 | 0.080 | 0.030 | 0.000 | 0.000 | 0.050 | 0.070 | 0.143 | 1175 | ○ | amorphous phase | 2.7 | 1.53 |
| 52 | Comp. Ex. | 0.820 | 0.060 | 0.010 | 0.080 | 0.030 | 0.000 | 0.000 | 0.000 | 0.070 | 0.143 | 1150 | x | — | — | — |
| 59 | Ex. | 0.815 | 0.060 | 0.010 | 0.080 | 0.030 | 0.000 | 0.005 | 0.000 | 0.070 | 0.143 | 1150 | ○ | amorphous phase | 1.8 | 1.53 |
| 60 | Ex. | 0.810 | 0.060 | 0.010 | 0.080 | 0.030 | 0.000 | 0.010 | 0.000 | 0.070 | 0.143 | 1150 | ○ | amorphous phase | 1.6 | 1.53 |
| 61 | Ex. | 0.800 | 0.060 | 0.010 | 0.080 | 0.030 | 0.000 | 0.020 | 0.000 | 0.070 | 0.143 | 1150 | ○ | amorphous phase | 1.7 | 1.53 |
| 62 | Ex. | 0.810 | 0.060 | 0.010 | 0.080 | 0.030 | 0.000 | 0.000 | 0.010 | 0.070 | 0.143 | 1150 | ○ | amorphous phase | 1.7 | 1.55 |
| 63 | Ex. | 0.790 | 0.060 | 0.010 | 0.080 | 0.030 | 0.000 | 0.000 | 0.030 | 0.070 | 0.143 | 1150 | ○ | amorphous phase | 1.6 | 1.56 |
| 64 | Ex. | 0.770 | 0.060 | 0.010 | 0.080 | 0.030 | 0.000 | 0.000 | 0.050 | 0.070 | 0.143 | 1150 | ○ | amorphous phase | 1.5 | 1.54 |

TABLE 5

| Sample No. | Example/ Comparative Example | Same as Sample No. 29 except for kind of M Kind of M (value: atomic number ratio) | 1175° C. Spray | XRD | Hc (A/m) | Bs (T) |
|---|---|---|---|---|---|---|
| 29 | Ex. | Nb | ○ | amorphous phase | 2.3 | 1.55 |
| 65 | Ex. | Hf | ○ | amorphous phase | 2.4 | 1.53 |
| 66 | Ex. | Zr | ○ | amorphous phase | 2.2 | 1.53 |
| 67 | Ex. | Ta | ○ | amorphous phase | 2.1 | 1.53 |
| 68 | Ex. | Mo | ○ | amorphous phase | 2.2 | 1.52 |
| 69 | Ex. | W | ○ | amorphous phase | 2.4 | 1.53 |
| 70 | Ex. | V | ○ | amorphous phase | 2.3 | 1.54 |
| 71 | Ex. | $Nb_{0.5}Hf_{0.5}$ | ○ | amorphous phase | 2.3 | 1.55 |
| 72 | Ex. | $Zr_{0.5}Ta_{0.5}$ | ○ | amorphous phase | 2.4 | 1.50 |
| 73 | Ex. | $Nb_{0.4}Hf_{0.3}Zr_{0.3}$ | ○ | amorphous phase | 2.4 | 1.53 |

TABLE 6

| Sample No. | Example/ Comparative Example | Fe (1 − (α + β)) X1αX2β (a to g and the kind of M are the same as those of Sample No. 29) | | | | | | | |
|---|---|---|---|---|---|---|---|---|---|
| | | X1 | | X2 | | 1175° C. | | Hc | Bs |
| | | Kind | α[1 − (a + b + c + d + e + f + g)] | Kind | β[1 − (a + b + c + d + e + f + g)] | Spray | XRD | (A/m) | (T) |
| 29 | Ex. | — | 0.000 | — | 0.000 | ○ | amorphous phase | 2.3 | 1.55 |
| 74 | Ex. | Co | 0.100 | — | 0.000 | ○ | amorphous phase | 2.3 | 1.53 |
| 75 | Ex. | Co | 0.400 | — | 0.000 | ○ | amorphous phase | 2.2 | 1.54 |
| 76 | Ex. | Ni | 0.100 | — | 0.000 | ○ | amorphous phase | 2.4 | 1.49 |
| 77 | Ex. | Ni | 0.400 | — | 0.000 | ○ | amorphous phase | 2.3 | 1.47 |
| 78 | Ex. | — | 0.000 | Al | 0.010 | ○ | amorphous phase | 2.3 | 1.45 |
| 79 | Ex. | — | 0.000 | Mn | 0.010 | ○ | amorphous phase | 2.4 | 1.53 |
| 80 | Ex. | — | 0.000 | Ag | 0.010 | ○ | amorphous phase | 1.9 | 1.53 |
| 81 | Ex. | — | 0.000 | Zn | 0.010 | ○ | amorphous phase | 2.3 | 1.54 |
| 82 | Ex. | — | 0.000 | Sn | 0.010 | ○ | amorphous phase | 2.1 | 1.52 |
| 83 | Ex. | — | 0.000 | As | 0.010 | ○ | amorphous phase | 2.1 | 1.52 |
| 84 | Ex. | — | 0.000 | Sb | 0.010 | ○ | amorphous phase | 2.4 | 1.51 |
| 85 | Ex. | — | 0.000 | Cu | 0.010 | ○ | amorphous phase | 1.9 | 1.52 |
| 86 | Ex. | — | 0.000 | Cr | 0.010 | ○ | amorphous phase | 2.4 | 1.52 |
| 87 | Ex. | — | 0.000 | Bi | 0.010 | ○ | amorphous phase | 2.3 | 1.54 |
| 88 | Ex. | — | 0.000 | N | 0.010 | ○ | amorphous phase | 2.3 | 1.51 |
| 89 | Ex. | — | 0.000 | O | 0.010 | ○ | amorphous phase | 2.1 | 1.52 |
| 90 | Ex. | — | 0.000 | La | 0.010 | ○ | amorphous phase | 2.1 | 1.49 |
| 90a | Ex. | — | 0.000 | Y | 0.010 | ○ | amorphous phase | 2.3 | 1.49 |
| 90b | Ex. | Co | 0.100 | Zn | 0.030 | ○ | amorphous phase | 2.1 | 1.51 |

Sample No. 12 to Sample No. 25 in Table 2 are examples and comparative examples with different M content (a), Ti content (b), and a+b.

In each example satisfying 0.001≤b≤0.140 and 0.020≤a+b≤0.140, coercivity and saturation magnetic flux density were favorable. On the other hand, no ribbon was manufactured in Sample No. 12 (b=0). In Sample No. 20 (a+b=0.015), the coercivity was large. In Sample No. 19 (a+b=0.150), the coercivity was large, and the saturation magnetic flux density was low. In Sample No. 25 (b=0.150), the saturation magnetic flux density was low.

Sample No. 26 to Sample No. 33 in Table 2 are examples and comparative examples with different B content (c).

In each example satisfying 0.020<c≤0.200, coercivity and saturation magnetic flux density were favorable. On the other hand, in Sample No. 26 (c=0.020), the ribbon before the heat treatment was crystalline, and the coercivity after the heat treatment was significantly large. In Sample No 33 (c=0.210), the saturation magnetic flux density was low.

Sample No. 34 to Sample 40 in Table 2 are examples and comparative examples with different P content (d).

In each example satisfying 0.010≤d≤0.150, coercivity and saturation magnetic flux density were favorable. On the other hand, no ribbon was manufactured in Sample No. 34 (d=0). In Sample No. 40 (d=0.160), the saturation magnetic flux density was low.

Sample No. 41 to Sample No. 44 in Table 2 are examples and comparative examples whose Si content (e) was changed from that of Sample No. 29.

In each example satisfying 0≤e≤0.060, coercivity and saturation magnetic flux density were favorable. On the other hand, the saturation magnetic flux density was low in Sample No. 44 (e=0.070).

Sample No. 45 to Sample No. 51 in Table 3 are examples and comparative examples whose ratio of "a" and "b" was changed while a+b was constant (0.070).

In each example satisfying 0.001≤b≤0.140, coercivity and saturation magnetic flux density were favorable. On the other hand, no ribbon was manufactured in Sample No. 45 (b=0). Compared to Sample No. 50 and Sample No. 51 (b/(a+b)>0.500), the saturation magnetic flux density was excellent in Sample No. 46 to Sample No. 49 (0.010≤b/(a+b)≤0.500).

Sample No. 53 to Sample No. 58 in Table 4 are examples whose S content (f) or C content (g) was different from that of Sample No. 29. Sample No. 52 is a comparative example whose spray temperature (1150° C.) was changed from that of Sample No. 29. Sample No. 59 to Sample No. 64 are examples whose spray temperature was changed from that of Sample No. 53 to Sample No. 58.

Table 4 shows that coercivity and saturation magnetic flux density were favorable even if S and/or C was/were added. Table 4 also shows that a ribbon was manufactured with a lower spray temperature by adding S and/or C compared to when S and/or C was/were not added. Table 4 also shows that coercivity was more favorable with a lower spray temperature.

Sample No. 65 to Sample No. 73 in Table 5 are examples whose kind of M was changed from that of Sample No. 29. Even if the kind of M was changed, coercivity and saturation magnetic flux density were favorable.

Sample No 74 to Sample No 90 in Table 6 are examples whose kind and amount of X1 and/or X2 were changed from those of Sample No. 29. Even if the kind and amount of X1 and/or X2 were changed, coercivity and saturation magnetic flux density were favorable.

Experimental Example 3

Experimental Example 3 was carried out with the same conditions as Sample No. 29 of Experimental Example 2 except for changing a rotating speed of a roller and further changing a heat treatment temperature. The results are shown in the following table. Incidentally, a ribbon of all samples described in the following table had a thickness of 50 to 55 μm.

TABLE 7

| | | a to g, α, and β are the same as those of Sample No. 29 | | | | | | | |
|---|---|---|---|---|---|---|---|---|---|
| Sample No. | Example/ Comparative Example | Rotating Speed of Roller (m/sec) | Average Grain Size of Initial Fine Crystal (nm) | Heat Treatment Temperature (° C.) | Average Grain Size of Fe based nanocrystalline (nm) | 1175° C. Spray | XRD | Hc (A/m) | Bs (T) |
| 29 | Ex. | 15 | no initial fine crystal | 600 | 8 | ○ | amorphous phase | 2.3 | 1.55 |
| 91 | Ex. | 15 | no initial fine crystal | 450 | 3 | ○ | amorphous phase | 2.9 | 1.42 |
| 91a | Comp. Ex. | 15 | no initial fine crystal | 400 | *no Fe based nanocrystalline* | ○ | amorphous phase | *4.3* | *1.32* |
| 92 | Ex. | 14 | 0.1 | 400 | 3 | ○ | amorphous phase | 2.5 | 1.41 |
| 93 | Ex. | 13 | 0.3 | 450 | 5 | ○ | amorphous phase | 2.3 | 1.51 |
| 94 | Ex. | 13 | 0.3 | 500 | 10 | ○ | amorphous phase | 2.3 | 1.52 |
| 95 | Ex. | 13 | 0.3 | 550 | 13 | ○ | amorphous phase | 2.2 | 1.53 |
| 96 | Ex. | 10 | 10.0 | 550 | 20 | ○ | amorphous phase | 2.3 | 1.54 |
| 97 | Ex. | 10 | 10.0 | 600 | 30 | ○ | amorphous phase | 2.6 | 1.52 |
| 98 | Ex. | 8 | 15.0 | 650 | 50 | ○ | amorphous phase | 2.9 | 1.47 |

Table 7 shows that initial fine crystal was generated in a ribbon before heat treatment by reducing a rotating speed of a roller. Table 7 also shows that Fe-based nanocrystalline had a smaller average grain size when the initial fine crystal had a smaller average grain size. Table 7 also shows that Fe-based nanocrystalline had a smaller average grain size when a heat treatment temperature was lower. On the other hand, Sample No. 91a (no Fe-based nanocrystalline) had a high coercivity and a low saturation magnetic flux density. Moreover, comparing Sample No. 91a and Sample No. 92 shows that Fe-based nanocrystalline was generated more easily when initial fine crystal existed than when no initial fine crystal existed.

What is claimed is:

1. A soft magnetic alloy comprising a composition of $(Fe_{(1-(\alpha+\beta))}X1_{\alpha}X2_{\beta})_{(1-(a+b+c+d+e+f+g))}M_aTi_bB_cP_dSi_eS_fC_g$, by atomic number ratio, in which X1 is one or more of Co and Ni, X2 is one or more of Al, Mn, Ag, Zn, Sn, As, Sb, Cu, Cr, Bi, N, O, and rare earth elements, M is one or more of Nb, Hf, Zr, Ta, Mo, W, and V, $0.020 \leq a+b \leq 0.140$ is satisfied, $0.001 \leq b \leq 0.140$ is satisfied, $0.020 < c \leq 0.200$ is satisfied, $0.010 \leq d \leq 0.150$ is satisfied, $0 \leq e \leq 0.060$ is satisfied, $a \geq 0$ is satisfied, $f \geq 0$ is satisfied, $g \geq 0$ is satisfied, $a+b+c+d+e+f+g < 1$ is satisfied, $\alpha \geq 0$ is satisfied, $\beta \geq 0$ is satisfied, and $0 \leq \alpha+\beta \leq 0.50$ is satisfied, wherein the soft magnetic alloy has a structure of Fe-based nanocrystalline.

2. The soft magnetic alloy according to claim 1, wherein the Fe-based nanocrystalline has an average grain size of 5 to 30 nm.

3. The soft magnetic alloy according to claim 1, wherein $0.010 \leq b/(a+b) \leq 0.500$ is satisfied.

4. The soft magnetic alloy according to claim 1, wherein $0 \leq f \leq 0.020$ and $0 \leq g \leq 0.050$ are satisfied.

5. The soft magnetic alloy according to claim 1, wherein $0.730 \leq 1-(a+b+c+d+e+f+g) \leq 0.950$ is satisfied.

6. The soft magnetic alloy according to claim 1, wherein $0 \leq \alpha\{1-(a+b+c+d+e+f+g)\} \leq 0.40$ is satisfied.

7. The soft magnetic alloy according to claim 1, wherein $\alpha=0$ is satisfied.

8. The soft magnetic alloy according to claim 1, wherein $0 \leq \beta\{1-(a+b+c+d+e+f+g)\} \leq 0.030$ is satisfied.

9. The soft magnetic alloy according to claim 1, wherein $\beta=0$ is satisfied.

10. The soft magnetic alloy according to claim 1, wherein $\alpha=\beta=0$ is satisfied.

11. The soft magnetic alloy according to claim 1, formed in a ribbon shape.

12. The soft magnetic alloy according to claim 1, formed in a powder shape.

13. A magnetic device comprising the soft magnetic alloy according to claim 1.

* * * * *